US008777640B2

(12) United States Patent
Buck et al.

(10) Patent No.: US 8,777,640 B2
(45) Date of Patent: Jul. 15, 2014

(54) ELECTRICAL CONNECTOR WITH IMPEDANCE CORRECTION ELEMENT AND METHOD FOR THE MANUFACTURE THEREOF

(75) Inventors: Carsten Buck, Heppenheim (DE); Torsten Sieler, Seeheim-Jungenheim (DE); Gregor Karrasch, Einhausen (DE)

(73) Assignee: Tyco Electronics AMP GmbH, Bensheim (DE)

( * ) Notice: Subject to any disclaimer, the term of this patent is extended or adjusted under 35 U.S.C. 154(b) by 0 days.

(21) Appl. No.: 13/266,994

(22) PCT Filed: Apr. 20, 2010

(86) PCT No.: PCT/EP2010/055169

§ 371 (c)(1), (2), (4) Date: Oct. 28, 2011

(87) PCT Pub. No.: WO2010/124965

PCT Pub. Date: Nov. 4, 2010

(65) Prior Publication Data

US 2012/0045938 A1 Feb. 23, 2012

(30) Foreign Application Priority Data

Apr. 30, 2009 (DE) ..... 10 2009 019 626

(51) Int. Cl.

| | |
|---|---|
| ***H01R 12/00*** | (2006.01) |
| ***H01R 13/6474*** | (2011.01) |
| ***H01R 12/16*** | (2006.01) |
| ***H01R 13/6477*** | (2011.01) |
| *H01R 12/58* | (2011.01) |

(52) U.S. Cl.

CPC ..... *H01R 13/6477* (2013.01); *H01R 13/6474* (2013.01); *H01R 23/7073* (2013.01); *H01R 12/58* (2013.01)

USPC ..... 439/79; 439/108

(58) Field of Classification Search

USPC ..... 439/79, 108, 607.05, 607.09–607.16, 439/941

See application file for complete search history.

(56) References Cited

U.S. PATENT DOCUMENTS 5,224,867 A * 7/1993 Ohtsuki et al. ..... 439/108

(Continued)

FOREIGN PATENT DOCUMENTS

DE 42 36 945 A1 5/1994

(Continued)

OTHER PUBLICATIONS

International Preliminary Report on Patentability, issued by the International Bureau of WIPO, Geneva, Switzerland, dated Nov. 1, 2011 for International Application No. PCT/EP2010/055169; 10 pages.

(Continued)

*Primary Examiner* — Thanh Tam Le

(74) *Attorney, Agent, or Firm* — Faegre Baker Daniels LLP

(57) ABSTRACT

The present invention relates to an electrical connector with an electrically insulating contact carrier and with at least one electrically conducting contact element which is held in the contact carrier. Furthermore, the present invention relates to a manufacturing method for manufacturing a connector of this type. Changes in dimension in the geometry of the contact carrier and also fluctuations in spacing and geometry in the enclosing shielding cause impedance inhomogeneities in the signal propagation direction that adversely influence the signal quality. Furthermore, it may be necessary to purposefully set the impedance so as to differ from the nominal impedance. An electrical connector is therefore proposed with an electrically insulating contact carrier (102) and with at least one electrically conducting contact element (104) which is held in the contact carrier (102), wherein at least one impedance correction element (112, 116) is arranged in the contact carrier (102) for setting the impedance of the connector (100) in the region in which the at least one contact element (104) is arranged.

8 Claims, 4 Drawing Sheets

(56) References Cited

U.S. PATENT DOCUMENTS

| | | | | |
|---|---|---|---|---|
| 5,304,069 | A * | 4/1994 | Brunker et al. | 439/108 |
| 5,525,067 | A * | 6/1996 | Gatti | 439/108 |
| 6,923,664 | B2 * | 8/2005 | Ito et al. | 439/108 |
| 6,953,351 | B2 * | 10/2005 | Fromm et al. | 439/101 |
| 7,066,744 | B2 * | 6/2006 | Kameyama et al. | 439/108 |
| 7,303,410 | B2 * | 12/2007 | Saito | 439/108 |
| 7,316,584 | B2 * | 1/2008 | Mackillop et al. | 439/607.05 |
| 7,351,120 | B1 | 4/2008 | Gilliland et al. | |
| 7,435,110 | B2 * | 10/2008 | Xiao et al. | 439/107 |
| 7,914,302 | B1 * | 3/2011 | Zhu | 439/79 |
| 2003/0032316 | A1 | 2/2003 | Bassler et al. | |
| 2003/0109152 | A1 | 6/2003 | Murata | |
| 2003/0134529 | A1 | 7/2003 | Murr et al. | |
| 2005/0101166 | A1 | 5/2005 | Kameyama | |
| 2007/0259568 | A1 | 11/2007 | Mackillop et al. | |

FOREIGN PATENT DOCUMENTS

| | | | |
|---|---|---|---|
| DE | 20 2008 003 914 | U1 | 5/2008 |
| EP | 0 455 367 | A2 | 11/1991 |
| EP | 0 596 313 | A2 | 10/1993 |
| WO | WO 2007/069307 | A1 | 6/2007 |
| WO | WO 2009/034616 | A1 | 3/2009 |

OTHER PUBLICATIONS

International Search Report and Written Opinion issued by the European Patent Office, Rijswijk, Netherlands, dated Aug. 26, 2010, for related International Application No. PCT/EP2010/055169; 16 pages.

Search Report issued by the German Patent and Trademark Office, Munich, Germany, dated Apr. 30, 2009 for related German Application No. 10 2009 019 626.9-34; 4 pages.

* cited by examiner

ELECTRICAL CONNECTOR WITH IMPEDANCE CORRECTION ELEMENT AND METHOD FOR THE MANUFACTURE THEREOF

The present invention relates to an electrical connector with an electrically insulating contact carrier and with at least one electrically conducting contact element which is held in the contact carrier. Furthermore, the present invention relates to a manufacturing method for manufacturing a connector of this type.

Signal lines generally transmit no direct current, but only pulsed current or alternating current. In order to prevent pulse reflections on signal lines, they must have above all a uniform, i.e. constant impedance. Reference is made to what is known as nominal impedance. Accordingly, for connecting lines, in particular in relation to high-speed data transmission, care must be taken to ensure that a constant impedance of this type is also adhered to in the associated plug connectors.

In principle, nominal impedance $Z_n$ is a property of pairs of signal lines. The nominal impedance is approximately independent of the length of the line, as the direct current resistance is negligible in signal lines of this type compared to the pulse resistance.

In known plug connectors, changes in diameter are provided along the electrical contact elements in order to compensate for fluctuations in impedance along the pin strip that are produced by changes in the geometry of the pin strip. Furthermore, it is known to bend the contact pins, which each pertain to complementary pairs of signal conductors, accordingly in order to generate a compensation of impedance.

However, these known methods on the one hand increase the cost of manufacture and on the other hand have the drawback that an altered nominal impedance can be implemented only by changing the tool.

The object on which the present invention is based consists in disclosing an electrical connector with an electrically insulating contact carrier and with at least one electrically conducting contact element that can be manufactured economically and the impedance of which is particularly simple to set.

This object is achieved by the subject matter of the independent claims. Advantageous developments of the electrical connector according to the invention are the subject matter of the independent claims.

In this regard, the present invention is based on the idea that an impedance correction can be implemented in a particularly simple manner in that an impedance correction element is arranged in the contact carrier for setting the impedance of the connector in the region in which the at least one contact element is arranged. A contact correction element of this type on the one hand can compensate for fluctuations in impedance along the pin strip that are produced by a change in the geometry of the pin strip and on the other hand can prevent jumps in impedance at the end of the pin strip.

According to a first advantageous embodiment of the present invention, an electrically conductive correction pin, which will be referred to hereinafter also as an impedance correction pin, can be used to compensate for impedance in a specific region of a contact carrier which may be a carrier both for sleeves and for pin contacts. If this impedance correction pin is inserted into the contact carrier parallel to the contacts having a defined geometry, depth and length, it is possible to generate an almost constant impedance course along the contact carrier. Jumps in impedance can thus be avoided and, in an advantageous manner, an impedance correction pin of this type allows the impedance to be purposefully set to so as to differ from the nominal impedance.

Alternatively or additionally to the impedance correction pin, an electrically insulating impedance compensation element can also be provided in the form of a dielectric element. This impedance compensation element is advantageous for preventing jumps in impedance at the end of the pin strip, in particular in the case of angled 90° downturns of the contacts. In this case, this additional element can either have the same dielectric constant as the contact carrier or else, as required, display a specific different dielectric constant.

In order to be able to adapt the impedance of the connector in a particularly simple manner, the contact carrier is constructed in such a way as to have a connection region for connecting a first external component and a contact region for contacting a second external component, the connection region and the contact region being joined together by a connecting region. According to the invention, a large number of contact elements are arranged in the contact carrier and the contact elements are symmetrically integrated in a cross section of the connecting region.

According to an advantageous embodiment of the present invention, the contact carrier has in the connecting region a borehole which is arranged symmetrically in relation to the contact elements and is preferably arranged centrically equidistantly to the contacts. This borehole is per se a dielectric which is different from the plastics material of the connector and can additionally in accordance with the invention receive the electrically conductive impedance correction pin. The impedance of the electrical connector is set via the position of the correction pin in the borehole. Furthermore, the shape and length and also the material of the correction pin influence the impedance of the electrical connector.

In a particularly simple manner, an impedance correction pin of this type is made of metal, preferably as an extruded part or turned part.

The simplest cross-sectional geometry is a circular cross section, although any other desired cross sections can of course also be used for the impedance correction pin. Thus, for example, the cross section may also be square or rectangular or have a different shape, depending on the costs of the production method and the specific impedance requirements. Furthermore, depending on the requirements of the compensation of impedance, the impedance correction pin according to the invention can also have a diameter course which varies in the longitudinal direction, i.e. for example be waisted.

The use of the impedance correction pin eliminates the need to use contact elements which have a plurality of changes in cross section and would be required in order to compensate for jumps in impedance. A contact having a constant cross-sectional course can be manufactured more economically. Furthermore, a purposeful and locally precise compensation of impedance or a purposeful influencing of impedance can be achieved by purposefully placing the impedance correction pin in the longitudinal direction of the pin strip, and also by selecting the length and the cross section of the impedance correction pin. This is important above all for use in high-speed data (HSD) pin strips or similar applications for high-frequency signal transmission.

According to an advantageous development of the present invention, the impedance correction element can have, alternatively or additionally to the impedance correction pin, an electrically insulating impedance compensation element. This dielectric element is used to prevent jumps in impedance at the end of the pin strip, in particular in the case of 90° contact downturns. As mentioned hereinbefore, the electrically insulating impedance compensation element can either have the same dielectric constant as the contact carrier or else have a different dielectric constant selected for improving the signal quality.

In an advantageous manner, the impedance compensation element is embodied in such a way that the contact elements are enclosed almost completely with plastics material in order to set the impedance to the impedance value of the pin strip even in the end region.

In order to improve understanding of the present invention, the invention will be described in greater detail based on the exemplary embodiments illustrated in the following figures. In this case, like parts are provided with like reference numerals and like component designations. Furthermore, a few features or combinations of features from the embodiments shown and described may represent solutions which are per se inventive or in accordance with the invention. In the drawings:

FIG. 1 is an exploded illustration of the electrical connector 100 according to the invention in accordance with a first advantageous embodiment.

Figure 1:
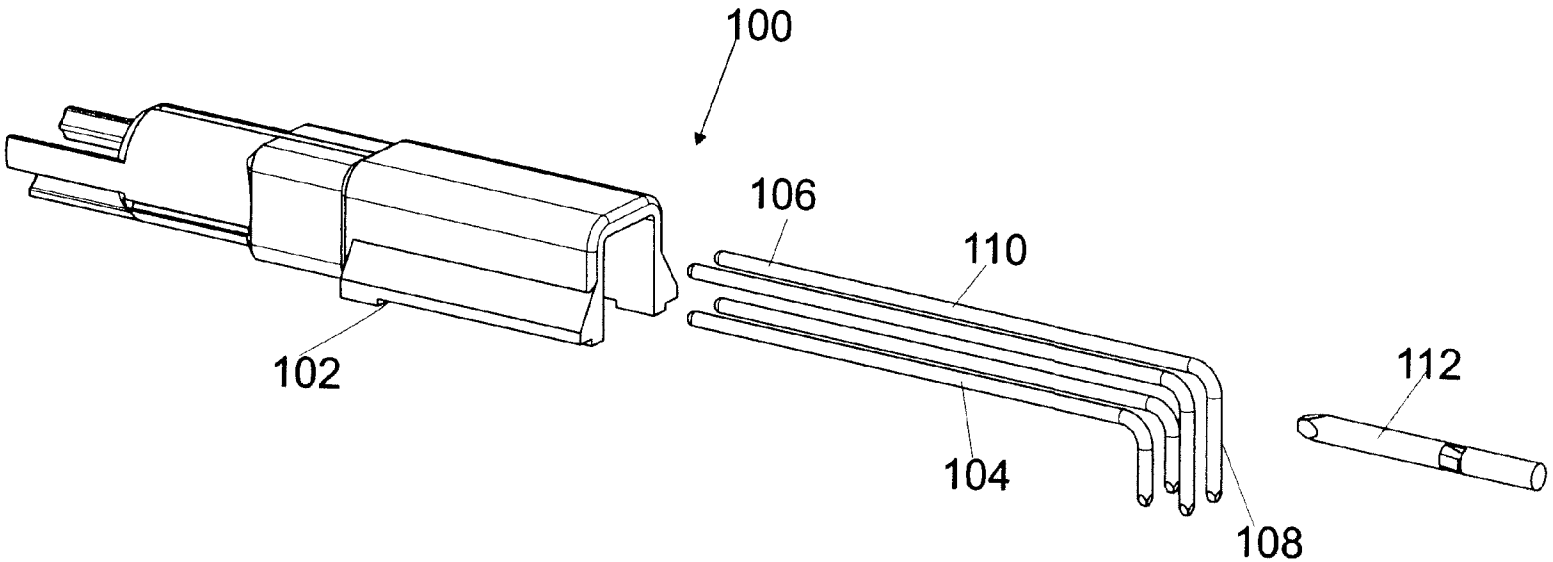
FIG. 1 is a perspective exploded illustration of an electrical connector with an impedance correction pin.

The electrical connector 100 comprises a contact carrier 102 which is made of a suitable electrically insulating material. In the specific embodiment shown in this figure, the plug connector is an angled plug connector such as is used for a connection between a printed circuit board and a signal line, for example. The present plug connector 100 is referred to as a four-pole high-speed data (HSD) pin strip. A total of four contact elements are provided, in this case contact pins, which are denoted by reference numeral 104. However, the principles according to the invention may of course also be used for plug connectors with contact sleeves as the contact elements.

Each of the contact pins 104 has a connection region 106 for connecting a first external component, for example the plug connector of a signal cable, and a contact region 108 for contacting a second external component, for example a printed circuit board. The connection region 106 and the contact region 108 are joined together via a connecting region 110, the longitudinal axis of the contact region 108 being angled by 90° in relation to the longitudinal axis of the connecting region and the connection region. The four contact pins 104 are arranged symmetrically in cross section in the connecting region 110.

Changes in dimension in the geometry of the contact carrier and also fluctuations in spacing and geometry in the enclosing shielding (not shown in this figure) cause impedance inhomogeneities in the signal propagation direction that adversely influence the signal quality. Furthermore, it may be necessary to purposefully set the impedance so as to differ from the nominal impedance.

As will become clear hereinafter with reference to the following figures, according to the invention, a metallic impedance correction pin 112 is therefore inserted into the contact carrier 102 centrically to the four contact pins 104.

As is apparent from the illustration of FIG. 1, the adaptation of impedance according to the invention allows the cross sections of the contact pins 104 to remain constant over the entire length, allowing particularly economical manufacturability and mountability of the contact pins 104 in the contact carrier 102 to be achieved.

Figure 2:
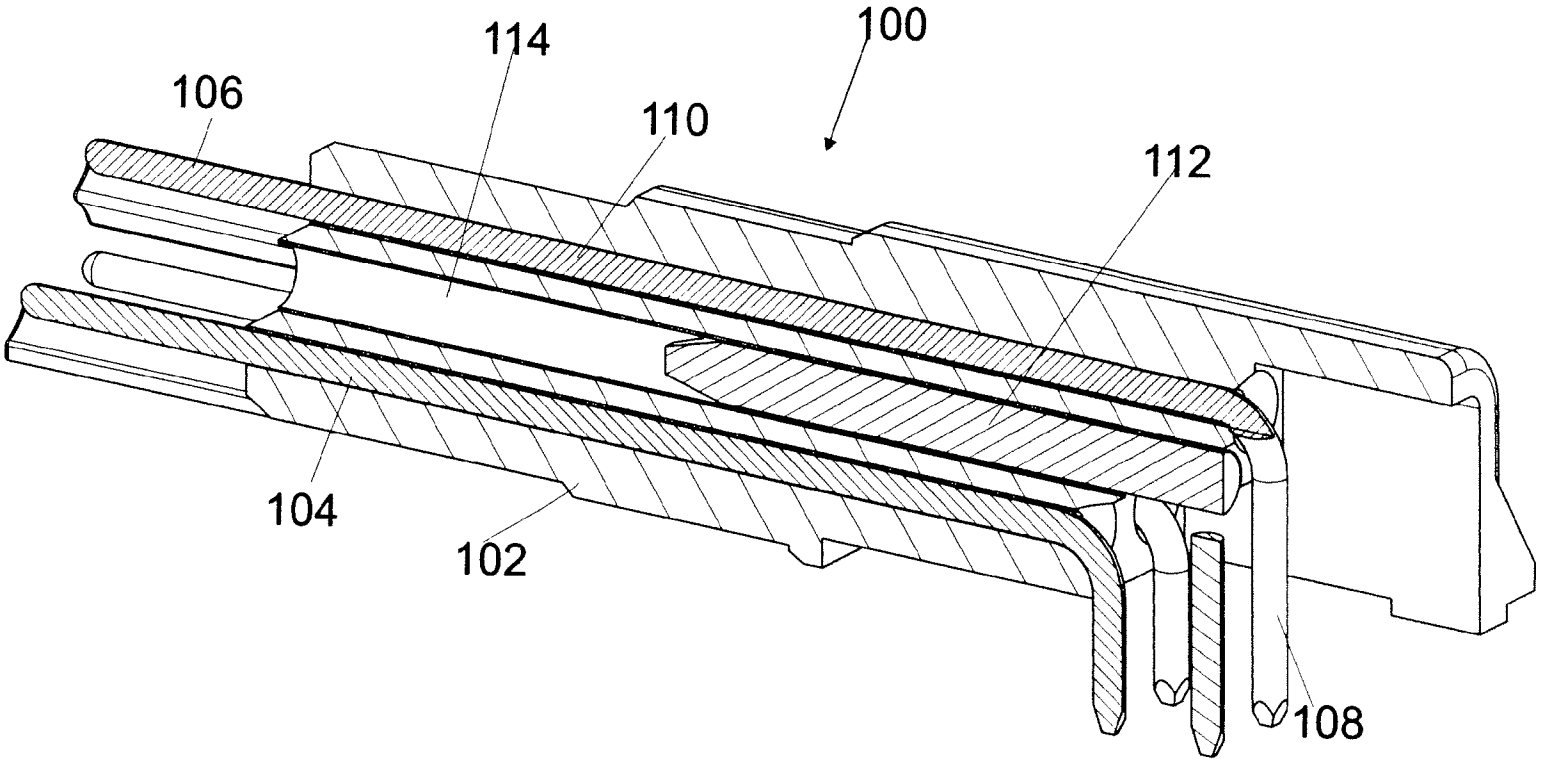
FIG. 2 is a cut-away illustration of the connector from FIG. 1.

The precise position of the electrically conducting impedance correction pin 112 in the contact carrier 102 is made clear from the cut-away illustration of FIG. 2. As may be seen from this figure, the contact carrier 102 has a continuous borehole 114 arranged centrally symmetrically in relation to the contact pins 104 in the connecting region 110. The metallic impedance correction pin 112 is pressed into the borehole 114 to a defined depth to compensate for impedance in a specific region of the pin strip.

According to the invention, an almost constant impedance course along the contact carrier can be generated by the electrically conductive impedance correction pin 112 which is inserted into the contact carrier 102 parallel to the contact pins 104 having a defined geometry, depth and length. Jumps in impedance can thus be avoided and, in addition, the impedance correction pin also allows an impedance to the set that purposefully differs from the nominal impedance.

According to the invention, to compensate for impedance in a specific region of the contact carrier 102, the metallic impedance correction pin 112 is inserted, parallel to the connecting and connection regions of the contact pins 104 with optimised spacing and at a defined depth, length and cross-sectional shape, into the contact carrier 102 in such a way that an almost homogeneous impedance course along the contact carrier is generated. In addition to the position in the borehole 114, the length as well as the cross-sectional shape of the impedance correction pin 112 can also vary as required. The impedance correction pin 112 is placed in the cross section-adapted borehole 114 in the contact carrier 102. There, it can also be displaced as required in the longitudinal direction in order to achieve a local compensation of impedance or purposeful influencing of impedance.

It goes without saying that the impedance correction pin 112 can also be fixed within the contact carrier at a predetermined position, for example by sheathing with plastics material. In this way, jumps in impedance can also be compensated for and a uniform impedance course along the pin strip can be achieved.

Figure 3:
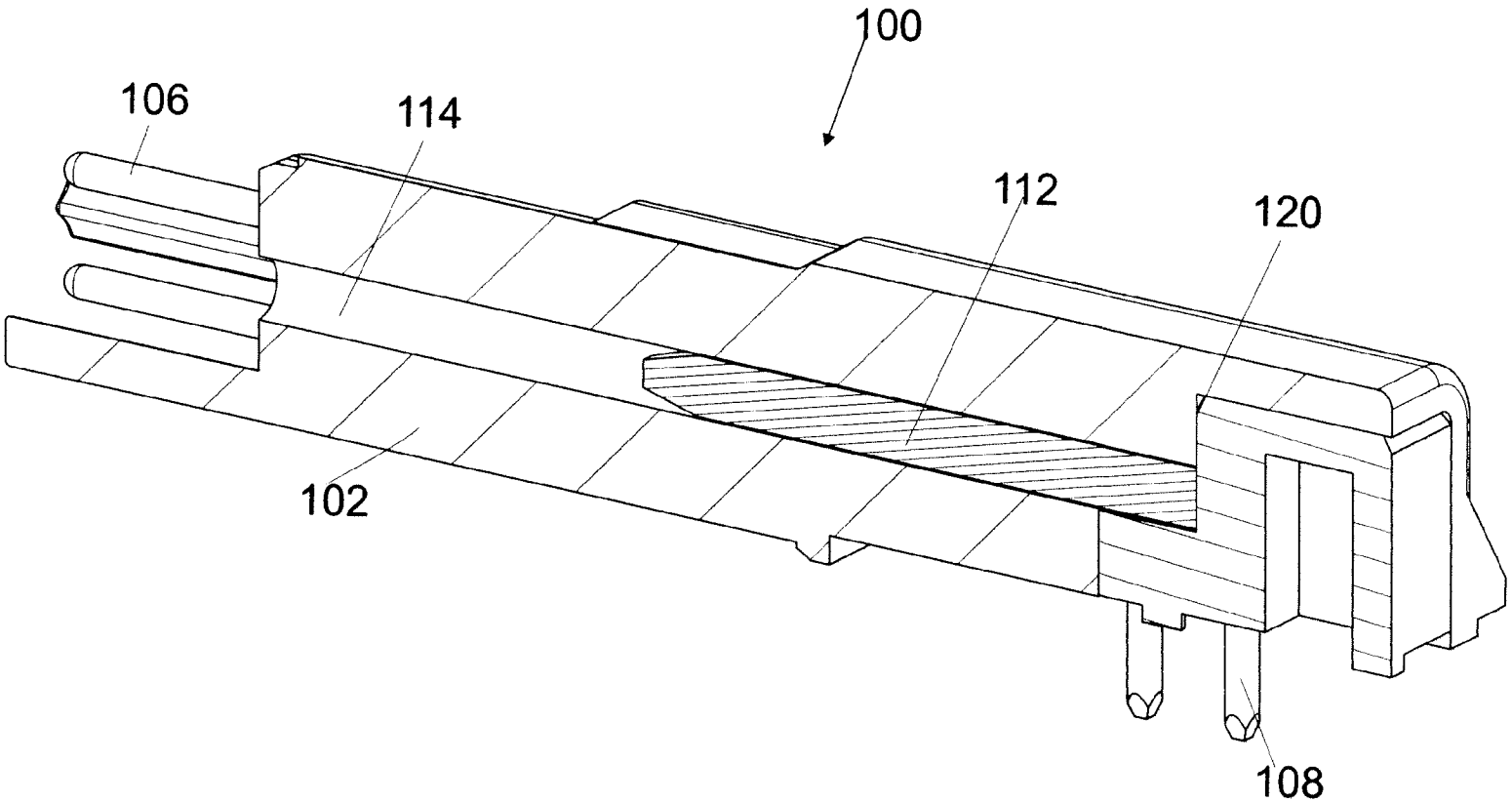
FIG. 3 is a cut-away illustration of an electrical connector with an impedance correction pin and additional dielectric impedance compensation element.
Figure 4:
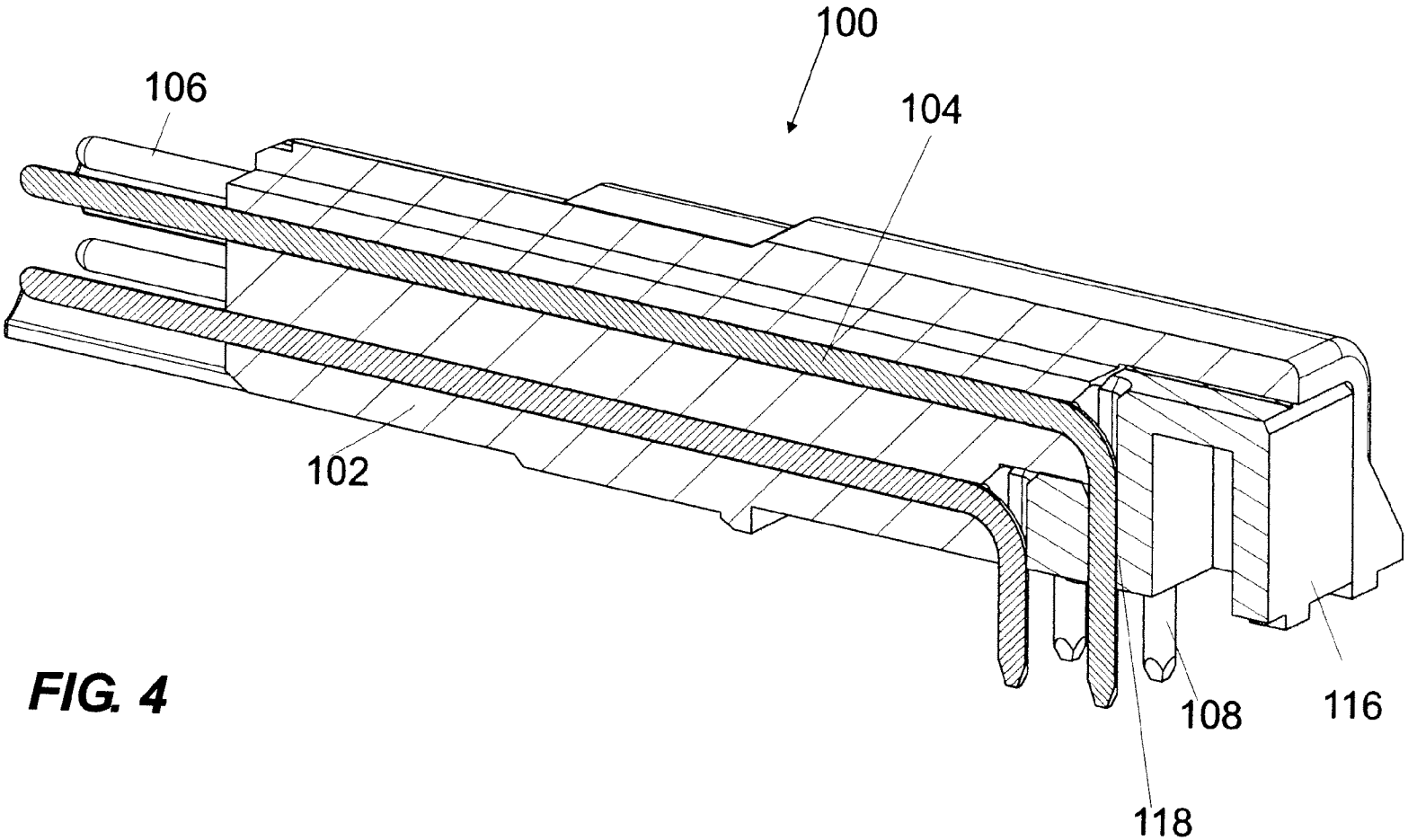
FIG. 4 is an unsymmetrical section through the embodiment of FIG. 3.

A further advantageous embodiment of the present invention will be described in detail with reference to FIGS. 3 and 4. Alternatively or additionally to the metallic impedance correction pin 112, an electrically insulating impedance compensation element 116 is provided here. This impedance compensation element 116 is slid onto the contact regions 108 of the contact pins 104 in such a way that the contact pins 104 are enclosed almost completely with plastics material in order to set the impedance to the impedance value of the pin strip in this region too. This smooths the impedance course of the pin strip and the quality of the signal to be transmitted is improved by minimising the reflected signal components.

According to the invention, the impedance compensation element 116 can be made of a material either having the same dielectric constant as the contact carrier 102 or else having a different dielectric constant. In the embodiment shown in this figure, contact bushings 118 are provided for the two longer contact pins, whereas the two shorter contact pins are only partially surrounded by the impedance compensation element.

The procedure in the mounting of the electrical connector according to the invention will be described hereinafter with reference to FIGS. 1 to 4.

In this procedure, a basic element, the contact carrier 102, is firstly manufactured and the contact elements 104 are arranged therein. This can take place either by sheathing or by pressing the metallic contact elements into the plastics material body. According to the invention, the arrangement is symmetrical in cross section in the connecting region 110.

A continuous borehole 114 is formed centrically between the four contact pins. However, it goes without saying that this borehole can also already be produced during the injection-moulding method. According to the invention, a metallic impedance correction pin 112, which was manufactured with a defined diameter and a precisely dimensioned defined length, is fitted into this borehole 114. In the sectional illustration shown in FIG. 3, the impedance correction pin 112 was fitted in flush with an edge 120 of the contact carrier 102. However, the precise position within the borehole 114 can be set individually.

In principle, it is also possible to jointly embed the impedance correction pin 112 into the plastics material matrix as early as during the injection-moulding of the contact carrier 102. This has the advantage that the manufacture of the electrical connector 100 has fewer steps, but has the drawback that it is subsequently no longer possible to adapt the impedance by altering the position of the impedance correction pin.

Alternatively or additionally to the metallic impedance correction pin 112, an electrically insulating impedance compensation element 116 is slid over the contact regions of the contact pins 104. This is especially advantageous for angled plug connectors in particular, in order to ensure that jumps in impedance can be prevented at the end of the pin strip. The quality of the signal to be transmitted is significantly improved by minimising the reflected signal components.

Finally, the entire arrangement can be mounted in a housing (not shown in the figures) which is also electrically conductive for shielding purposes.

As mentioned hereinbefore, the principles according to the invention are advantageous in particular for high-speed data transmission and similar applications in high-frequency signal transmission.

The invention claimed is:

1. Electrical connector with an electrically insulating contact carrier and with at least one electrically conducting contact element which is held in the contact carrier, wherein at least one impedance correction element is arranged in the contact carrier for setting the impedance of the connector in the region in which the at least one contact element is arranged; wherein the at least one contact element comprises a contact pin angled through 90° and wherein the impedance correction element comprises an electrically conductive impedance correction pin parallel to the contact pin, and the at least one electrically conducting contact element has a connection region for connecting a first external component and a contact region for contacting a second external component, the connection region and the contact region being joined together by a connecting region and a large number of contact elements, which are arranged symmetrically in a cross section of the connecting region, being arranged in the contact carrier, and the contact carrier has, in the vicinity of the connecting region, a borehole arranged symmetrically in relation to the contact elements, and the impedance correction element comprises the electrically conductive impedance correction pin received in the borehole and the impedance of the electrical connector is set via the position of the impedance correction pin in the borehole.

2. Electrical connector according to claim 1, further comprising an electrically insulating impedance compensation element.

3. Electrical connector according to claim 2, wherein the electrically insulating impedance compensation element comprises at least one contact bushing for at least partially receiving the at least one contact element.

4. Electrical connector according to claim 1, wherein the impedance correction element comprises the electrically conductive impedance correction pin made of metal.

5. Electrical connector according to claim 1, wherein the impedance correction element comprises the electrically conductive impedance correction pin having a round or angular cross section.

6. Electrical connector according to claim 1, further comprising an electrically insulating impedance compensation element made of a dielectric material having the same dielectric constant as or a defined different dielectric constant from the contact carrier.

7. Method for manufacturing an electrical connector with an electrically insulating contact carrier and with at least one electrically conducting contact element which is held in the contact carrier, wherein the method includes the following steps:

forming the at least one contact element with a contact pin angled through 90°;

mounting the at least one contact element in the contact carrier;

mounting an impedance correction element in the contact carrier for setting the impedance of the connector in the region in which the at least one contact element is arranged;

providing the impedance correction element with an electrically conductive impedance correction pin parallel to the contact pin;

forming the at least one contact element includes forming at least a first contact element and a second contact element; and mounting the impedance correction element includes mounting the impedance correction element approximately equidistantly from the first contact element and the second contact element.

8. Method according to claim 7, wherein the step of mounting an impedance correction element includes at least one of the steps of:

positioning the electrically conductive impedance correction pin in the contact carrier; and attaching an electrically insulating impedance compensation element to the at least one contact element.

* * * * *